US007341622B2

(12) United States Patent
Takagi

(10) Patent No.: US 7,341,622 B2
(45) Date of Patent: Mar. 11, 2008

(54) INK-JET INK PRODUCTION METHOD AND INK-JET RECORDING METHOD

(75) Inventor: Toshiya Takagi, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 11/079,991

(22) Filed: Mar. 14, 2005

(65) Prior Publication Data

US 2005/0217536 A1 Oct. 6, 2005

(30) Foreign Application Priority Data

Mar. 30, 2004 (JP) ..... 2004-098126

(51) Int. Cl.
*C09D 11/00* (2006.01)

(52) U.S. Cl. ..... 106/31.27; 106/31.6

(58) Field of Classification Search ..... 106/31.27, 106/31.6

See application file for complete search history.

(56) References Cited

U.S. PATENT DOCUMENTS

| | | | | |
|---|---|---|---|---|
| 5,373,212 | A * | 12/1994 | Beau | 310/316.01 |
| 6,733,113 | B2 * | 5/2004 | Yoshizawa et al. | 347/68 |
| 6,824,260 | B2 * | 11/2004 | Blease et al. | 347/86 |
| 2004/0119797 | A1 * | 6/2004 | Yoshizawa et al. | 347/85 |
| 2005/0057631 | A1 * | 3/2005 | Morimoto | 347/100 |

* cited by examiner

*Primary Examiner*—J. A. Lorengo
*Assistant Examiner*—Veronica Faison-Gee
(74) *Attorney, Agent, or Firm*—Frishauf, Holtz, Goodman & Chick, P.C.

(57) ABSTRACT

A method of producing an ink-jet ink containing the steps in the order named: (a) dispersing colorant particles, a dispersing agent, and a solvent mixture containing water and a water-soluble organic solvent so as to obtain a dispersion of the colorant particles; (b) filtering the dispersion of the colorant particles using a hollow fiber filter; and (c) applying ultrasonic degassing treatment to the filtered dispersion of the colorant particles to obtain the ink-jet ink, wherein a content of oxygen in the ink-jet ink is not more than 2 ppm based on the total weight of the ink-jet ink.

7 Claims, No Drawings

INK-JET INK PRODUCTION METHOD AND INK-JET RECORDING METHOD

FIELD OF THE INVENTION

The present invention relates to a production method of an ink-jet ink for ink-jet printing, and an ink-jet recording method.

BACKGROUND OF THE INVENTION

An image printing method employing ink-jet systems is one in which minute ink droplets are ejected from an ink-jet recording head and deposited onto recording media to be printed. Ink-jet recording systems feature a mechanism which is relatively simple and low in cost, and also enables forming highly detailed images of high quality.

Taking advantages of such ink-jet recording systems, image printing onto textiles, so-called ink-jet textile printing, has been developed. Differing from conventional textile printing, ink-jet textile printing exhibits advantages which makes it possible to quickly form images of excellent gradation without need of plate making. Further, since only the amount of ink which is necessary is used to form images, the ink-jet textile printing is considered as an excellent image forming method to minimize environmental pollution due to its minimal effluent.

In ink-jet textile printing, the types of usable dyes are limited depending on the kinds of fibers constituting textile, and disperse dyes are commonly employed for dying polyester based fibers.

There are various types of ink-jet recording systems include. On-demand type recording systems, which are the main stream in recent years, are divided into a so-called piezo system (a piezoelectric system) employing a piezo element, and a thermal ink-jet system (the BABBLE JET (a registered trade name) system). Of these, in the ink-jet recording system employing the piezo system, it has been known that since decrease and increase in pressure are repeated innumerable times during ink ejection, tiny air bubbles tend to form due to cavitation, resulting in absence of dots during ink ejection and shifting ink deposition position, whereby degradation of print quality such as graininess occurs.

Generally, cavitation, as described herein, refers to the physical phenomenon in which when the pressure of a liquid at a certain temperature becomes lower than the vapor pressure to be exhibited at the above temperature, the liquid evaporates, forming bubbles. On account of that, ink-jet ink to be employed is generally degassed to minimize gas content in the ink-jet ink, whereby generation of air bubbles during ejection is minimized. Degassing is performed employing, for example, a method in which an ink-jet ink is degassed under reduced pressure, a method in which ultrasonic waves are applied to an ink-jet ink for degassing, and a method in which a degassing hollow fiber membrane is used, as described in Japanese Patent Publication Open to Public Inspection (hereinafter referred to as JP-A) No. 11-209670. Further, an ink-jet printer is proposed which incorporates a device capable of continuously practicing an ultrasonic degassing method and a hollow fiber degassing method. Still further, though a physical method is not employed, JP-A No. 11-263929 proposes a method in which formation of air bubbles are minimized employing surface active agents.

Any of the methods proposed above exhibit some preferred effects for soluble type ink-jet inks. However, in the dispersion system in which pigments and disperse dyes which are barely soluble or insoluble in water are employed, it is difficult to achieve stable ejection while simultaneously minimizing the generation of cavitation. Further, when an ultrasonic degassing device or a hollow fiber membrane degassing device is incorporated in an ink-jet printer, it is necessary to install each of such degassing devices for each of the ink-jet series of each color. As a result, a relatively enormous amount of space is required, whereby the size of the ink-jet printer increases, resulting in an inevitable increase in device production cost. Consequently, the above methods are not regarded as efficient ones. In addition, problems are included in which when these devices malfunction, it makes the ink-jet printer inoperable. Still further, when these devices are not used for an extended period of time, problems occur in which coagula are generated in the ink cartridge or prior to reaching the degassing device due to the gas incorporated in the ink-jet ink.

On the other hand, disclosed is a processing method (refer, for example, to Patent Document 1) of a recording liquid, which decreases fluctuation of the amount of ejected ink by performing an ultrasonic degassing treatment or a vacuum degassing treatment after preparing an aqueous pigment based recording liquid composing dispersing agents, water-soluble media, pigments and water. However, the above disclosed method aims at improving dispersibility of pigment particles or enhancing the uniformity of the particle size distribution by removing air absorbed on the surface of pigment particles, and further increasing mutual interaction with dispersing agents via simultaneously performing an ultrasonic treatment and a vacuum degassing treatment, but does not aim at improving cavitation in the ink-jet ink. Further, neither description nor suggestion is made in regard to the minimization of generation of cavitation in cases in which disperse dyes are specifically employed as a colorant.

Further, proposed is a method (refer, for example, to Patent Document 2) in which dispersibility of pigments is enhanced by peptizing the secondary coagula of pigment particles, formed during preparation of concentrated colorant dispersion, which is prepared by applying ultrasonic wave energy to a highly concentrated colorant dispersion at during preparation of ink. However, the above disclosed method aims to re-disperse coagulated pigment particles into the primary particles, employing ultrasonic wave energy, and does not intend to improve cavitation in the ink-jet ink. Further, neither description nor suggestion is made in regard to prevention of the formation of cavitation under specifically use of disperse dyes as a colorant.

As noted above, the present situation is one in which a dispersion based ink-jet ink has not yet been attained which simultaneously satisfies stable ejection and cost as desired.

(Patent Document 1) JP-A No. 9-286943 (claims)

(Patent Document 2) JP-A No. 11-228892 (claims)

SUMMARY OF THE INVENTION

In view of the foregoing problems, the present invention was realized. An object of the present invention is to provide a production method of a dispersion based ink-jet ink which results in excellent ejection and produces high quality images with improved graininess, as well as an ink-jet recording method.

An aspect of the present invention includes a method of producing an ink-jet ink containing the steps in the order named: (a) dispersing colorant particles, a dispersing agent, and a solvent mixture containing water and a water-soluble organic solvent so as to obtain a dispersion of the colorant particles; (b) filtering the dispersion of the colorant particles using a hollow fiber filter; and (c) applying ultrasonic degassing treatment to the filtered dispersion of the colorant particles to obtain the ink-jet ink having a low content of air therein.

DETAILED DESCRIPTION OF THE INVENTION

The present invention can be achieved by the following embodiments.

(1) A method of producing an ink-jet ink comprising the steps in the order named:

(a) dispersing colorant particles, a dispersing agent, and a solvent mixture containing water and a water-soluble organic solvent so as to obtain a dispersion of the colorant particles;

(b) filtering the dispersion of the colorant particles using a hollow fiber filter; and (c) applying ultrasonic degassing treatment to the filtered dispersion of the colorant particles to obtain the ink-jet ink, wherein a content of oxygen in the ink-jet ink is not more than 2 ppm based on the total weight of the ink-jet ink.

(2) The method of producing an ink-jet ink of the above-described item 1, wherein the colorant particles and the solvent mixture have a D(AB) value of not less than 1500, D(AB) being defined by the following Formula (1):

$$D(AB)=(\gamma D_A-\gamma D_B)^2+(\gamma P_A-\gamma P_B)^2+(\gamma H_A-\gamma H_B)^2 \quad \text{Formula (1)}$$

$\gamma D_A$: a dispersive component of a surface energy for the colorant particles obtained by Young-Fowkes equation;

$\gamma D_B$: a dispersive component of a surface energy for the solvent mixture obtained by Young-Fowkes equation;

$\gamma P_A$: a polar component of a surface energy for the colorant particles obtained by Young-Fowkes equation;

$\gamma P_B$: a polar-component of a surface energy for the solvent mixture obtained by Young-Fowkes equation;

$\gamma H_A$: a hydrogen bonding component of a surface energy for the colorant particles obtained by Young-Fowkes equation; and $\gamma H_B$: a hydrogen bonding component of a surface energy for the solvent mixture obtained by Young-Fowkes equation.

(3) The method of producing an ink-jet ink of the above-described items 1 or 2, wherein the colorant particles are a dispersion dye.

(4) The method of producing an ink-jet ink of any one of the above-described items 1 to 3, wherein a viscosity of the ink-jet ink is from 5 to 15 mPa·s.

(5) The method of producing an ink-jet ink of any one of the above-described items 1 to 4, wherein a content of the colorant particles in the ink-jet ink is from 3 to 20 weight % based on the total weight of the ink-jet ink.

(6) A method of recording an ink-jet image comprising the step of:

ejecting droplets of the ink-jet ink produced by the method of any one of the above-described items 1 to 5 from a multiplicity of nozzles of an ink-jet head onto a recording material, wherein a diameter of the nozzles is from.10 to 50 μm.

(7) A method of recording an ink-jet image comprising the step of:

ejecting droplets of the ink-jet ink produced by the method of any one of the above-described items 1 to 5 from a multiplicity of nozzles of an ink-jet head onto a textile material, wherein the textile material is a polyester fiber having a ink receptive layer thereon.

Based on the present invention, enabled is a production method of a dispersion based ink-jet ink which results in excellent ejection and produces high quality mages with improved graininess, as well as an ink-jet recording method.

The most preferred embodiments to practice the present invention will be detailed below.

The dispersion based ink-jet ink (hereinafter, occasionally referred simply to as the ink), containing at least a colorant, a dispersing agent, water, and a water-soluble organic solvent, is characterized in that the particle diameter variation ratio of colorant particles prior to and after the degassing treatment employing a hollow fiber membrane and ultrasonic waves is controlled to be within ±5 percent when a degassing treatment employing the hollow fiber membrane and ultrasonic waves is performed prior to charging the ink into a cartridge. Further, by adjusting, to at most 2 ppm, the dissolved oxygen concentration in the dispersion based ink-jet ink after degassing, it is possible to realize stable ejection.

Namely, the inventors of the present invention examined each of the degassing methods which have conventionally been proposed or disclosed. As a result, when these methods were independently employed, it was discovered that it was difficult to achieve stable ejection. Subsequently, in regard to an optimal degassing method, various methods were studied. As a result, it was discovered that by performing degassing with a combination of an ultrasonic treatment and a hollow fiber membrane treatment, it was possible to achieve stable ejection and to obtain high quality images with improved graininess, being the objects of the present invention, whereby the present invention was realized.

In the present invention, the sequence of the ultrasonic degassing treatment and the hollow fiber membrane degassing treatment is not particularly limited. However, due to the reasons below, it is preferable that the hollow fiber membrane degassing treatment is initially conducted, followed by the ultrasonic degassing treatment, since the effects of the present invention are thereby more evident.

Actions and mechanisms of the degassing treatments according to the present invention are not fully understood at the present stage, but are assumed to be as follows.

By performing, as a first stage, hollow fiber membrane degassing treatment, it is possible to remove gas dissolved in the ink as well as minute bubbles (called bubble nuclei) existing in solvents. However, the surface of colorant particles in the ink is not completely covered with dispersing agents but adhered by minute bubbles (bubble nuclei).

In such a state, by performing the ultrasonic degassing treatment as a second stage, it is assumed that ultrasonic vibration is applied to the colorant particles, whereby bubble nuclei adhered on the colorant particle surface are subjected to coalescence and released to float to the liquid-air interface or are dissolved in the solvents, whereby bubbles are eliminated.

In the production method of the ink-jet ink of the present invention, the sequence of the degassing treatment employing a hollow fiber membrane module is as follows. For example, ink is fed to the interior of the hollow fiber membrane from an ink feeding inlet at one end of the module, and sucked from the gas vent in the wall on the module side, and the pressure on the outside of the hollow fiber membrane is reduced to at most 10 kPa, while dissolved gas in the ink which is permeated through the membrane is discharged. Subsequently, the degassed ink is discharged to the exterior from the ink outlet at the other end. Degassing treatment employing the above hollow fiber membrane module may also be conducted in such a manner that the ink is fed to the exterior of the hollow fiber membrane while the pressure of the interior is reduced. Employed as hollow fiber membrane degassing modules used in the present invention are those which are commercially available such as the MHF Series available from Mitsubishi Rayon Co., Ltd. and the SEPAREL Series, available form Dainippon Ink and Chemicals, Inc.

The production method of the ink-jet ink of the present invention is characterized in that the concentration of oxygen dissolved in the ink-jet ink is controlled to be at most 2 ppm.

The concentration of dissolved air as defined in the present invention can be determined as follows. The concentration of oxygen dissolved in an ink-jet ink is determined and the target concentration is obtained based on the oxygen ratio in air.

The concentration of dissolved oxygen can be determined employing methods and devices such as the Ostwald method (refer to page 241 of Jikken Kagaku Koza (Experimental Chemistry Lectures) 1 Kihon Sosa (Basic Operations) [1], 1975, Maruzen), mass spectrometry, simple oxygen analyzers such as a galvanic cell type analyzer or a polarography type analyzer, or colorimetry. Further, the concentration of dissolved oxygen can easily be determined employing a commercially available dissolved oxygen meter (Type DO-30A, available from DKK-TOA Corp.).

In the present invention, it is characterized that the concentration of dissolved oxygen in the ink-jet ink is at most 2 ppm, is preferably 0-2 ppm, but is more preferably 0-1 ppm. It is not preferred that the concentration of dissolved oxygen in the ink-jet ink exceeds 2 ppm, since, at such level, cavitation tends to occur during ink ejection.

In the production method of the ink-jet ink of the present invention, methods for controlling the concentration of dissolved oxygen specified in the present invention to be at most 2 ppm are not particularly limited. However, it is possible to achieve the above concentration by suitably selecting a degree of pressure reduction or an ink liquid treatment rate (ml/minute) during the degassing treatment employing a hollow fiber membrane.

Ultrasonic treatment devices which can be employed for the ultrasonic degassing treatment in the production method of the ink-jet ink of the present invention are not particularly limited. However, it is possible to use, for example, a circulation type RUS-699T device (at a frequency of 20 kHz and a maximum output of 600 W), produced by Nippon Seiki Seisakusho, as well as a continuous type Model 900 Type (at a frequency of 20 kHz and a maximum output of 900 W), produced by Branson Company.

In the production method of the ink-jet ink of the present invention, one of its features is that the variation ratio of colorant particles prior to and after the degassing treatment employing ultrasonic waves and the hollow fiber membrane is within ±5 percent.

It is assumed that effects, exhibited by the production method of the present invention in which an ink is prepared under the conditions such that the diameter of colorant particles results in almost no variation prior to and after the degassing treatment, are not due to the enhancement of ejection caused by the enhancement of dispersibility but ejection stability is realized due to lack of cavitation during ink ejection from the recording head.

In the present invention, it is necessary that treatment conditions to control the intensity of ultrasonic waves, such as frequency, amplitude, or irradiating energy are optimally set so that, as noted above, by applying ultrasonic vibration to colorants, bubble nuclei adhered on the colorant particle surface are subjected to coalescence and are released to float to the air-liquid interface, or to be dissolved in solvents, and further, conditions are set so that the diameter of colorant particles results in no variation due to dispersion, peptization, or coagulation.

Accordingly, the frequency is preferably at most 30 kHz, but is more preferably in the range of 10-30 kHz. Frequencies above 30 kHz are not preferred, since dispersibility is degraded due to an increase in coagulating action.

Further, as the amplitude increases, cavitation pressure increases. Consequently, the commonly employed amplitude is preferably in the range of 20-60 μm.

Still further, the irradiating energy is preferably $1\times10^4$-$1\times10^5$ J, but is more preferably $2\times10^4$-$8\times10^4$ J. When the irradiating energy is less than $1\times10^4$ J, capability to remove bubble nuclei is insufficient, while when it exceeds $1\times10^5$ J, temperature increases to result in coagulation. As a result, neither case is not preferred.

Still further, in the production method of the ink-jet ink of the present invention, D(AB), represented by Formula (1) below, of at least one of the combinations of colorant (A) and water or water-soluble organic solvent (B) is preferably at least 1,500.

$$D(AB)=(\gamma D_A-\gamma D_B)^2+(\gamma P_A-\gamma P_B)^2+(\gamma H_A-\gamma H_B)^2 \qquad \text{Formula (1)}$$

wherein $\gamma D_A$: a dispersive component of the surface energy of colorant (A), obtained by the Young-Fowkes equation;

$\gamma D_B$: a dispersive component of the surface energy of water or water-soluble organic solvent (B), obtained by the Young-Fowkes equation;

$\gamma P_A$: a polar component of the surface energy of colorant (A), obtained by the Young-Fowkes equation;

$\gamma P_B$: a polar component of the surface energy of water or water-soluble organic solvent (B), obtained by the Young-Fowkes equation;

$\gamma H_A$: a hydrogen bonding component of the surface energy of colorant (A), obtained by the Young-Fowkes equation; and $\gamma H_B$: a hydrogen bonding component of the surface energy of water or water-soluble solvent (B), obtained by the Young-Fowkes equation.

Namely, when the difference in the surface energy between coolant (A) and water or water-soluble organic solvent (B) is excessively small, the surface of colorants becomes more wettable. However, it is not preferable since the dispersion stability is degraded due to a simultaneous increase in the solubility.

Consequently, when the difference in the surface energy between colorant (A) and water or water-soluble solvent (B) is somewhat greater, namely by achieving a combination resulting in D(AB)of at least 1,500 obtained by above Equation (1), it is possible to realize enhanced dispersion stability.

Incidentally, the Young-Fowkes equation, as described herein, is represented by the equation below.

$$WSL=2\{(\gamma SD\cdot\gamma LD)^{1/2}+(\gamma SP\cdot\gamma LP)^{1/2}+(\gamma SH\cdot\gamma LH)^{1/2}\}$$

γL=γLD+γLP+γLH: surface free energy of the liquid

γS=γSD+γSP+γSH: surface free energy of the solid

γD: dispersive component of surface free energy

γP: polar component of surface free energy

γH: hydrogen bonding component of surface free energy

Each of the constitution elements of the ink-jet ink according to the present invention will now be described.

Listed as colorants usable in the dispersion based ink-jet ink, as described in the present invention, may be pigments or disperse dyes, and of these, it is particularly preferable to use disperse dyes.

Employed as pigments may be the inorganic and organic ones known in the art.

Examples of organic pigments include azo pigments such as azo lakes, insoluble azo pigments, condensed azo pigments, or chelate azo pigments; polycyclic pigments such as phthalocyanine pigments, perylene and perylene pigments, anthraquinone pigments, quinacridone pigments, dioxazine pigments, thioindigo pigments, isoindolinone pigments, or quinophtharony pigments, dye lakes such as basic dye type lakes, or acidic dye type lakes; and nitro pigemtns, nitroso pigments, aniline black, and daylight fluorescent pigments while examples of inorganic pigments include various kinds of carbon black.

Specific organic pigments are listed below.

Examples of magenta and red pigments are as follows:

C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48, C. I. Pigment Red 53, C. I. Pigment Red 57, C. I. Pigment Red 122, C. I. Pigment Red 139, Pigment Red 144, Pigment Red 149, Pigment Red 166, Pigment Red 177, Pigment Red 178 and Pigment Red 222.

Examples of orange and yellow pigments are as follows:

C. I. Pigment Orange 31, C. I. Pigment Orange 43, C. I. Pigment Yellow 12, Pigment Yellow 13, Pigment Yellow 14, Pigment Yellow 15, Pigment Yellow 17, Pigment Yellow 74, Pigment Yellow 93, Pigment Yellow 94, Pigment Yellow, Pigment Yellow 128 and Pigment Yellow 138.

Examples of green and cyan pigments are as follows:

C. I. Pigment Blue 15, C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Examples of dispersion dyes preferably used inn the present invention are: an azo dispersion dye, a quinone dispersion dye, an anthraquinone dispersion dye and a quinophthalone dispersion dye. Specific examples are shown below, however, the present invention is not limited by them.

[C. I. Disperse Yellow]

3, 4, 5, 7, 9, 13, 23, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 108, 114, 116, 118, 119, 122, 124, 126, 135, 140, 141, 149, 160, 162, 163, 164, 165, 179, 180, 182, 183, 184, 186, 192, 198, 199, 202, 204, 210, 211, 215, 216, 218, 224, 227, 231, 232.

[C. I. Disperse Orange]

1, 3, 5, 7, 11, 13, 17, 20, 21, 25, 29, 30, 31, 32, 33, 37, 38, 42, 43, 44, 45, 46, 47, 48, 49, 50, 53, 54, 55, 56, 57, 58, 59, 61, 66, 71, 73, 76, 78, 80, 89, 90, 91, 93, 96, 97, 119, 127, 130, 139, 142.

[C. I. Disperse Red]

1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 298, 302, 303, 310, 311, 312, 320, 324, 328.

[C. I. Disperse Violet]

1, 4, 8, 23, 26, 27, 28, 31, 33, 35, 36, 38, 40, 43, 46, 48, 50, 51, 52, 56, 57, 59, 61, 63, 69, 77.

[C. I. Disperse Green]

9.

[C. I. Disperse Brown]

1, 2, 4, 9, 13, 19.

[C. I. Disperse Blue]

3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, 333.

[C. I. Disperse Black]

1, 3, 10, 24.

The content of the colorant is preferably 3-20 percent by weight of the ink, but is more preferably 5-13 percent by weight.

Commercially available colorants may be employed without any modification, but they are preferably purified. Employed as purification methods may be prior art recrystallization methods, as well as washing. It is preferable that organic solvents employed for the purification methods and purification treatments are suitably selected depending on the types of dyes.

In the ink according to the present invention, water-insoluble dyes, pigments, dispersing agents, humectants, media, and optional additives are blended, and the resulting mixture may be dispersed employing a homogenizer. Employed as homogenizers may be prior art ball mills, sand mills, line mills, and high pressure homogenizers.

It is preferable that the average diameter of disperse dye particles is at most 300 nm, while the maximum particle diameter is at most 900 nm. When the average particle diameter as well as the maximum particle diameter are relatively large, in the ink-jet recording method in which ejection is performed from minute nozzles, it becomes impossible to achieve stable ejection due to the fact that clogging tends to occur. It is possible to determine the average particle diameter employing commercially available particle size measurement devices employing a light scattering method, an electrophoretic method, or a laser Doppler method. A specific example of the particle size measurement device includes Zeta Sizer 1000, produced by Malvern Co.

Examples of dispersing agents preferably employed in the present invention include formalin condensation products of creosote oil sodium sulfonate (e.g., DEMOL C), formalin condensation products of sodium cresolsulfonate and sodium 2-naphthol-6-sulfonate, formalin condensation products of sodium cresolsulfonate, formalin condensation products of sodium phenolsulfonate, formalin condensation products of sodium β-naphthalenesulfonate, formalin condensation products of sodium β-naphthalenesulfonate and (e.g., DEMOL N) and sodium β-naphtholsulfonate, lignin-slufonates (e.g., VANILEX RN), sodium paraffin sulfonate (e.g., EFCOL 214), and copolymers (e.g., FLORENE G-700) of maleic anhydride.

The used amount of dispersing agents is preferably 20-200 percent by weight with respect to the disperse dyes. When the addition amount is less than the above lower limit, a decrease in particle size, as well as degraded dispersion occurs, while when it is more than the upper limit, a decrease in particle size as well as degraded dispersion stability also occurs, resulting in an undesired increase in viscosity. These dispersing agents may be employed singly or in combination.

Preferred humectants according to the present invention include sodium dodecylbenzenesulfonate, sodium 2-ethylhexylsulfosuccinate, sodium alkylnaphthalenesulfonate, phenol oxidized ethylene addition products, and acetylenediol oxidized ethylene addition products.

Depending on the structure of employed pigments and disperse dyes, during dispersion, foaming or gelling may occur, and in addition, fluidity is occasionally degraded. Consequently, it is necessary that dispersing agents as well as humectants are selected while considering humidifying capability, minute particle forming capability, and dispersion stability, as well as foaming during dispersion, gelling of the dispersion, and fluidity of the dispersion. Further, it is preferable to select dispersing agents and humectants, taking into account effects of dying properties to textiles, dying ratio, leveling properties, migration properties, color saturation, and durability and further, non-uniformity of dying due to tar formation of dispersing agents and humectants during color formation at relatively high temperatures. No dispersing agents have been found which meet all the above demands. As a result, it is required that matching dyes to be dispersed, optimal dispersing agents are selected, and if desired, defoamers are added.

Since no dispersing agents have been found which meet all the above requirements, it is necessary that matching the types of colorants to be dispersed, an optimal dispersing agent is selected, and if desired, defoamers are added.

Listed as water-soluble organic solvents according to the present invention are, for example, polyhydric alcohols (e.g., ethylene glycol, glycerine, 2-ethyl-2-(hydroxymethyl)-1,3-propanediol, tetraethylene glycol, triethylene glycol, tripropylene glycol, 1,2,4-butanetriol, diethylene glycol, propylene glycol, dipropylene glycol, butylene glycol, 1,6-hexabediol, 1,6-hexanediol, 1,2-hexanediol, 5-pentanediol, 1,2-pentanediol, 2,2-dimethyl-1,3-propanediol, 2-methyl-2,4-pentanediol, 3-methyl-1,5-pentanediol, 3-methyl-1,3-butnaediol, and 2-methyl-1,3-propanediol), amines (e.g., ethanolamine and 2-(dimethylamino)ethanol), monohydric alcohols (e.g., methanol, ethanol, and butanol), alkyl ethers of polyhydric alcohols (e.g., diethylene glycol monomethyl ether, diethylene glycol monobutyl ether, triethylene glycol monomethyl ether, triethylene glycol monobutyl ether, ethylene glycol monomethyl ether, ethylene glycol monobutyl ether, propylene glycol monomethyl ether, propylene glycol monobutyl ether, and dipropylene glycol monomethyl ether), 2,2-thiodiethanol, amides (e.g., N,N-dimethylformamide), heterocycles (2-pyrrolidone), and acetonitrile. The amount of water-soluble organic solvents is preferably 10-60 percent by weight with respect to the weight of the total ink.

In order to stably maintain the viscosity and dyes of ink and to improve color formation, inorganic salts may be added to the ink. Listed as such inorganic salts are, for example, sodium chloride, sodium sulfate, magnesium chloride, and magnesium sulfide. In cases in which the present invention is practiced, inorganic salts are not limited thereto.

Employed as surface active agents may be any of the cationic, anionic, amphoteric, and nonionic ones. Listed as cationic surface active agents are aliphatic amine salts, aliphatic quaternary ammonium salts, benzalconium salts, benzetonium chloride, pyridinium salts, and imidazolinium salts. Listed as anionic surface active agents are fatty acid soap, N-acyl-N-methylglycine salts, N-acyl-N-methyl-β-alanine salts, N-acylglutamic acid salts, alkyl ether carboxylic acid salts, acrylated peptides, alkylsulfonic acid salts, alkylbenzenesulfonic salts, alkylnaphthalenesulfonic acid salts, dialkylsulfosuccinic acid ester salts, alkylsulfoacetic acid salts, α-olefinsulfonic acid salts, N-acylmethyltaurine, sulfonated oil, higher alcohol sulfuric acid ester salts, secondary higher alcohol sulfuric acid ester salts, alkyl ether sulfuric acid salts, secondary higher alcohol ethoxysulfates, polyoxyethylene alkyl phenyl ether sulfuric acid salts, secondary higher alcohol ethoxysulfates, polyoxyethylene alkyl phenyl ether sulfuric acid salts, monoglysulfates, fatty acid alkylolamido sulfuric acid ester salts, alkyl ether phosphoric acid ester salts, and alkyl phosphoric acid ester salts. Listed as amphoteric surface active agents are carboxybetaine types, sulfobetaine types, aminocarboxylic acid salts, and imidazoliniumbetaine. Listed as nonionic surface active agents are polyoxyethylene alkyl ether, polyoxyethylene secondary alcohol ether, polyoxyethylene alkyl phenyl ether (for example, Emulgen 911), polyoxyethylene sterol ether, polyoxyethylene lanoline derivatives, polyoxyethylene polyoxypropylene alkyl ether (for example, NEWPOL PE-62), polyoxyethylene glycerin fatty acid ester, polyoxyethylene castor oil, cured castor oil, polyoxyethylene sorbitan fatty acid ester, polyoxyethylene sorbitol fatty acid ester, polyethylene glycol fatty acid ester, fatty acid monoglycerides, polyglycerin fatty acid ester, sorbitan fatty acid ester, propylene glycol fatty acid ester, sucrose fatty acid ester, fatty acid alknaolamides, polyoxyethylene fatty acid amides, polyoxyethylene alkylamine, alkylamine oxides, acetylene glycol, and acetylene alcohol. However, the present invention is not limited to the above.

When these surface active agents are employed, they may be employed individually or in combinations of at least two types. The added amount is preferably in the range of 0.001-1.0 percent by weight with respect to the total amount of the ink, since it is possible to optionally control the surface tension of inks.

In order to achieve storage stability of ink over an extended period of time, incorporated may be antiseptic as well as antifungal agents into the inks. Listed as antiseptic and antifungal agents are aromatic halides (for example, REVENTOL CMK), methylene dithiocyanate, halogen-containing nitrogen sulfur compounds, and 1,2-benzisothiazoline-3-one (for example, PROXEL GXL). However, the present invention is not limited thereto.

The viscosity of the ink-jet ink according to the present invention, which is constituted as above, is preferably 5-15 mPa·s, but is more preferably 5-10 mPa·s. When the viscosity of the ink is less than 5 mPa·s, the meniscus during ink ejection becomes unstable, while when it exceeds 15 mPa·s, a higher voltage is required during ejection. In both cases, ejection stability is degraded.

It is preferable that dying aids are incorporated in textile printing ink-jet ink employed during dying employing a high temperature steaming method or textiles employed for textile printing. During steaming of textiles to be printed, dying-aids form eutectic mixtures with water condensed in the form of textile, decrease of the moisture amount to be re-vaporized, and shorten temperature elevating time. Further, the resulting eutectic mixtures dissolve dyes on fibers and enhance the diffusion rate of dyes to fibers. Listed as such a dying aid is urea.

Recording heads employed in the ink-jet recording method of the present invention are not particularly limited, and it is possible to use either the thermal type or the piezo type.

In the present invention, in order to produce highly detailed images, it is preferable that recording is performed employing ink-jet heads of a nozzle diameter of 10-50 μm. To enhance graininess, it is preferable that the nozzle diameter is smaller. However, since excessively small ink droplets are affected by air flow, the diameter is most preferably in the range of 10-40 μm.

The driving frequency of an ink-jet head driving device is preferably at least 20 kHz, but to minimize clogging of ink, is more preferably 30-100 kHz. Based on the same reasons, the ink ejection rate is preferably at least 6 m/second, but is more preferably 8-50 m/second.

In the ink-jet recording method of the present invention, with the view of minimizing the effects of air flow near the recording heads, the volume of ink droplets during deposition is preferably at least 5 pl, and with the view of graininess of printed images, is more preferably at most 150 pl, but is most preferably 5-80 pl.

Commonly employed as textiles in the present invention are those which comprises polyester fibers as a main component. Fabric comprising polyester fibers as the main component may be employed in any form of textiles, knitted, and nonwoven fabrics. It is preferable that textiles comprises 100 percent polyester fibers, but it is possible to use blended yarn fabrics or blended yarn nonwoven fabrics with rayon, silk, polyurethane, acryl, nylon, and wool. Further, the size of threads constituting above textiles is preferably in the range of 10-100 d.

In the ink-jet recording method in which the dispersion based ink-jet ink according to the present invention is employed, in order to minimize image bleeding, it is preferable that an ink receptive layer is subjected to a pre-treatment. Employed as the pre-treatment may be a method in which at least one of a water-soluble polymer, a water-soluble metal salt, a polycationic compound, a surface active agent and a water repellent is provided in an amount of 0.2-50 percent by weight. It is preferable that methods which are suitable for fiber components are employed.

Employed as water-soluble metal salts may be inorganic and organic salts of alkaline or alkaline earth metals such as KCl or $CaCl_2$.

Employed as polycationic compounds may be polymers or oligomers of various types of quaternary ammonium salts, as well as polyamine salts.

Some of water-soluble metal salts and polycationic compounds vary the tint of dyed products or degrade lightfastness. Consequently, it is preferable to select those considering targeted products to be dyed.

Employed as water-soluble polymers may be natural polymers (e.g., corn and wheat starch, cellulose derivatives such as carboxymethyl cellulose, methyl cellulose, hydroxyethyl cellulose, polysaccharides such as sodium alginate, guar gum, tamarind gum, locust bean gum, or gum Arabic, and proteins such as gelatin, casein, or keratin), as well as synthetic polymers (e.g., polyvinyl alcohol, polyvinylpyrrolidone, and acrylic acid based polymers).

Employed as surface active agents are, for example, anionic, cationic, amphoteric and nonionic ones. Representative anionic surface active agents include higher alcohol sulfuric acid ester salts, sulfonic acid salts of naphthalene derivatives, cationic surface active agents include quaternary ammonium salts, and amphoteric surface active agents include imidazoline derivatives, while nonionic surface active agents include polyoxyethylene alkyl ethers, polyoxypropylene block polymers, sorbitan fatty acid esters, polyoxyethylene sorbitan fatty acid esters, and ethylene oxide addition products of acetylene alcohol.

Listed as water repellents are, for example, silicone and fluorine based, and wax based ones.

It is preferable that water-soluble polymers as well as surface active agents, which are previously used to treat the textiles, are stable at high temperatures so that when ink-jet printing is performed and color is formed at high temperatures, they do not cause staining due to tar formation. Further, it is preferable that water-soluble polymers and surface active agents are easily removed from ink-jet printed textiles via washing after color formation at high temperature.

Still further, in view of dying properties, it is possible to previously provide textiles with carriers. Preferred compounds employed as a carrier are those which exhibit features such as high enhancement of dying, simple application methods, high stability, and minimal toxic effects to the human body and environments, easy removal from fibers, and no adverse effect to color fastness. Listed as examples of carriers may be phenols such as o-phenylphenol, p-phenylphenol, methylnaphthalene, alkyl benzoate, alkyl salicylate, chlorobenzene, or diphenyl, ethers, organic acids, and hydrocarbons. These compounds enhance swelling and plasticization of fibers so that disperse dyes easily enter the fiber interior.

Still further, it is possible to previously provide textiles with dying aids. Dying aids form eutectic compounds with water condensed on textiles and decrease the amount of moisture to be re-evaporated and shorten the temperature elevation time. In addition, the resulting eutectic compounds dissolve dyes on fibers and enhance the diffusion rate of dyes to fibers. Listed as a dying aid is urea.

It is preferable that the above pre-treatment agents are appropriately selected corresponding to textile components as well as textile structures and are incorporated employing a pad method, a coating method, or a spray method to reach an amount of 0.2-50 percent by weight. In the textile printing of the present invention, images are formed on textiles comprising fibers capable of being dyed employing the above disperse dyes, employing an ink-jet recording method (being an ink providing process). Thereafter, ink-treated textiles are subjected to a thermal treatment (being a thermal treatment process), whereby textile printing is completed and further, thermally treated textiles are cleaned (being a cleaning process), whereby a printed textile product is obtained. In the textile printing method of the present invention, in order to allow dispersion dyes to fix onto fibers, a method is employed in which ink-treated textiles are subjected to a thermal treatment. Further, in order to remove unfixed dyes from dyed textiles, it is possible to use conventional cleaning methods known in the art. However, it is particularly preferable to use reduction cleaning.

In the ink-jet recording method which results in textile printing up, it is preferable that after ink ejection, the printed textile is wound, is subjected to color formation by heating, cleaned and subsequently dried. In ink-jet textile printing, when textiles printed with ink are allowed to stand without any treatment, dying is not sufficiently achieved. Further, in cases in which printing is performed on a long textile over an extended period of time, the printed textile is continually produced and is allowed to pile onto a floor, taking room and resulting in insecurity and occasionally unintentional staining. Due to that, after printing, winding operation is essential. In such an operation, placed between textile layers are paper, cloth, and vinyl sheets which do not adversely affect printing. However, in cases in which the textile is cut during printing or in short length, winding is not always required.

Printed textiles may immediately, or after some time, be subjected to a thermal treatment, subsequently are dried and are subjected to a color formation treatment depending on uses. Selected as thermal treatment methods are those using ovens, heating rolls, or steam, which match the use.

Cleaning is required after the thermal treatment. The reasons are as follows. When dyes, which have not used, remain, color stability is degraded to lower color durability. Further, it is necessary to remove materials used for the pre-treatment. When they are not removed, durability is not only degraded, but also textiles are colored. Due to that, it is necessary perform cleaning corresponding to materials to be removed and the purposes.

After cleaning, drying is required. After squeezing the textile material for dehydration, the resulting textiles are naturally dried or dried employing a dryer, a heating roller or a pressing iron.

Further, in the case of the ink-jet recording method of the present invention, in order to obtain a uniformly dyed product, prior to pre-treatment, it is preferable to remove natural impurities (oils and fats, wax, pectin, and natural dyes) which have adhered onto textile fibers, residues (starch) of chemical agents employed during textile production, and dirt of an ink receptive layer. Employed as cleaning agents to achieve cleaning are alkalis such as sodium hydroxide and sodium carbonate, surface active agents such as nonionic surface active agents, and enzymes.

Via a series of these actions, features of ink-jet ink for textile printing are exhibited, whereby textiles which are printed with targeted patterns are prepared.

EXAMPLES

The present invention will now be described with reference to examples, but the present invention is not limited thereto. In the examples below, "parts". as well as "%" is "parts by weight" or "% by weight", respectively, unless otherwise noted.

<<Preparation of Dyes>>

(Preparation of Purified Dye 1)

Commercially available C.I. Disperse Yellow 149 was suspended in a reflux state employing methanol, stirred, filtered, dried, and then recrystallized employing ethyl acetate, whereby Purified Dye 1 was obtained.

(Preparation of Purified Dye 2)

Commercially available C.I. Disperse Red 302 was suspended in a refluxed state employing methanol, stirred, filtered, dried, and then recrystallized employing ethyl acetate, whereby Purified Dye 2 was obtained.

(Preparation of Purified Dye 3)

Commercially available C.I. Disperse Blue 60 was suspended in a refluxed state employing acetonitrile, stirred, filtered, dried, and then recrystallized employing ethyl acetate, whereby Purified Dye 3 was obtained.

(Preparation of Purified Dye 4)

Commercially available C.I. Disperse Violet 57 was suspended in a refluxed state employing acetonitrile, stirred, filtered, dried, and then recrystallized employing ethyl acetate, whereby Purified Dye 4 was obtained.

<<Preparation Stock Ink Liquid 1>>

(Preparation of Stock Ink Liquid A)

<Preparation of Dispersion A>

After blending each of the additives below, the resulting mixture was dispersed employing a sand grinder. Dispersion was terminated when the average particle diameter reached 170 nm, whereby Dispersion A was prepared.

| | |
|---|---|
| Purified Dye 1 (C.I. Disperse Yellow 149) | 30 parts |
| Glycerin (Gly) | 10 parts |
| Ion-exchanged water | 45 parts |
| Sodium lignin sulfonate (VANILEX RN, produced by Nippon Paper Group, Inc.) | 15 parts |

<Preparation of Stock Ink Liquid>

After blending each of the components below, the resulting mixture was filtered employing a 0.3 μm membrane filter, whereby dispersion-based Stock Ink Liquid A was prepared.

| | |
|---|---|
| Dispersion A | 10 parts |
| Ethylene glycol (EG) | 40 parts |
| Glycerin (Gly) | 20 parts |
| PROXEL GXL (D) (produced by Avicia Co.) | 0.01 part |
| Ion-exchanged water | 30 parts |

(Preparation of Stock Ink Liquid B)

<Preparation of Dispersion B>

After blending each of the additives below, the resulting mixture was dispersed employing a sand grinder. Dispersion was terminated when the average particle diameter reached 160 nm, whereby Dispersion B was prepared.

| | |
|---|---|
| Purified Dye 2 (C.I. Disperse Red 302) | 30 parts |
| Glycerin (Gly) | 10 parts |
| Ion-exchanged water | 30 parts |
| Sodium lignin sulfonate (VANILEX RN, produced by Nippon Paper Group, Inc.) | 30 parts |

<Preparation of Stock Ink Liquid>

After blending each of the components below, the resulting mixture was filtered employing a 0.3 μm membrane filter, whereby dispersion-based Stock Ink Liquid B was prepared.

| | |
|---|---|
| Dispersion B | 20 parts |
| Ethylene glycol (EG) | 20 parts |
| Glycerin (Gly) | 10 parts |
| PROXEL GXL (D) (produced by Avicia Co.) | 0.01 part |
| Ion-exchanged water | 50 parts |

(Preparation of Stock Ink Liquid C)

<Preparation of Dispersion C>

After blending each of the additives below, the resulting mixture was dispersed employing a sand grinder. Dispersion was terminated when the average particle diameter reached 130 nm, whereby Dispersion C was prepared.

| | |
|---|---|
| Purified Dye 3 (C.I. Disperse Blue 60) | 30 parts |
| Ethylene glycol | 20 parts |
| Ion-exchanged water | 35 parts |
| Sodium creosote oil sulfonate (DEMOL C, produced by Kao Corp.) | 15 parts |

<Preparation of Stock Ink Liquid>

After blending each of the components below, the resulting mixture was filtered employing a 0.3 μm membrane filter, whereby dispersion-based Stock Ink Liquid B was prepared.

| | |
|---|---|
| Dispersion C | 40 parts |
| Ethylene glycol (EG) | 20 parts |
| Glycerin (Gly) | 10 parts |
| PROXEL GXL (D) (produced by Avicia Co.) | 0.01 part |
| Ion-exchanged water | 30 parts |

(Preparation of Stock Ink Liquid D)

<Preparation of Dispersion D>

After blending each of the additives below, the resulting mixture was dispersed employing a sand grinder. Dispersing was terminated when the average particle diameter reached 130 nm, whereby Dispersion D was prepared.

| | |
|---|---|
| Purified Dye 4 (C.I. Disperse Violet 57) | 30 parts |
| Ethylene glycol | 20 parts |
| Ion-exchanged water | 35 parts |
| Sodium lignin sulfonate (VANILEX RN, produced by Nippon Paper Group, Inc.) | 15 parts |

<Preparation of Stock Ink Liquid>

After blending each of the components below, the resulting mixture was filtered employing a 0.3 μm membrane filter, whereby dispersion-based Stock Ink Liquid D was prepared.

| | |
|---|---|
| Dispersion D | 40 parts |
| Ethylene glycol (EG) | 10 parts |
| Glycerin (Gly) | 10 parts |
| PROXEL GXL (D) (produced by Avicia Co.) | 0.01 part |
| Ion-exchanged water | 40 parts |

<<Ink Preparation 2>>

Inks 1-17 were prepared by combining each of Stock Ink Liquids A-D, prepared as above, with each of Degassing Methods 1-6, as listed in Table 2.

(Degassing Method of Stock Ink Liquid)

(Degassing Treatment 1: Hollow Fiber Degassing→Ultrasonic Treatment)

Stock ink liquid, prepared as above, was subjected to a degassing treatment employing a hollow fiber membrane module (SEPAREL PF-004D, produced by Dainippon Ink and Chemical Co., Ltd.) under a pressure of 8 kPa at a flow rate of 1 L/minute, and subsequently subjected to a single pass treatment employing an ultrasonic homogenizer, circulation type RUS-600T (at a frequency of 20 kHz and an output of 600 W), produced by Nippon Seiki Seisakusho, at an irradiation energy of $3.6\times10^4$ J and a flow rate of 1 L/minute.

After continuously performing each of the above treatments, the resulting ink was placed in a cartridge, whereby a dispersion based ink was prepared.

Degassing Treatment 2: Ultrasonic Treatment→Hollow Fiber Degassing)

Stock ink liquid, prepared as above, was subjected to a single pass treatment employing an ultrasonic homogenizer, circulation type RUS-600T (at a frequency of 20 kHz and an output of 600 W), produced by Nippon Seiki Seisakusho, at an irradiation energy of $3.6\times10^4$ J and a flow rate of 1 L/minute, and subsequently subjected to a degassing treatment employing a hollow fiber membrane module (SEPAREL PF-004D, produced by Dainippon Ink and Chemicals, Inc.) under a pressure of 8 kPa at a flow rate of 1 L/minute.

After continuously performing each of the above treatments, the resulting ink was placed in a cartridge, whereby a dispersion based ink was prepared.

(Degassing Treatment 3: Vacuum Degassing Treatment)

Stock ink liquid, prepared as above, was subjected to a vacuum degassing treatment under the condition of 93 kPa for one hour. Then, the resulting ink was placed in a cartridge, whereby a dispersion based ink was prepared.

(Degassing Treatment 4: Hollow Fiber Treatment, Only)

Stock ink liquid prepared as above was subjected to a degassing treatment employing a hollow fiber membrane module (SEPAREL PF-004D, produced by Dainippon Ink and Chemicals, Inc.) under a pressure of 8 kPa at a flow rate of 1 L/minute. Thereafter, the resulting ink was placed in a cartridge, whereby a dispersion based ink was prepared.

(Degassing Treatment: Ultrasonic Treatment, Only)

Stock ink liquid prepared as above was subjected to a single pass treatment employing-an ultrasonic homogenizer, circulation type RUS-600T (at a frequency of 20 kHz and an output of 600 W), produced by Nippon Seiki Seisakusho, at an irradiation energy of $3.6\times10^4$ J and a flow rate of 1 L/minute. Then, the resulting ink was placed in a cartridge, whereby a dispersion based ink was prepared.

(Degassing Treatment 6: Vacuum Degassing Treatment→Ultrasonic Treatment)

Stock ink liquid, prepared as above, was subjected to a vacuum degassing treatment under the condition of 93 kPa for one hour, and thereafter, was subjected to a single pass treatment employing an ultrasonic homogenizer, circulation type RUS-600T (at a frequency of 20 kHz and an output of 600 W), produced by Nippon Seiki Seisakusho, at an irradiation energy of $3.6\times10^4$ J and a flow rate of 1 L/minute. The resulting ink was placed in a cartridge, whereby a dispersion based ink was prepared.

Incidentally, Ink 6 listed in Table 2 was prepared in the same manner as Ink 5, except that during preparation of Stock Ink Liquid 5, the frequency during the ultrasonic treatment and the irradiation energy were altered to 35 kHz and $2.0\times10^6$ J, respectively. Further, Inks 7 and 8 were prepared in the same manner as Ink 5, except that during preparation of Stock Ink Liquid 5, the hollow degassing treatment condition during Degassing Treatment 1 was altered to a pressure of 10 kPa and the flow rate of the stock ink liquid was altered to 2 L/minute and 5 L/minute, respectively.

<<Determination of Each Characteristic Value>>

Each of the characteristic values of stock ink liquids and inks, prepared as above, was determined based on the methods below.

(Determination of Surface Energy of Colorants and Solvents)

The contact angle of colorants was determined 5 times employing a contact angle meter CA-V, produced by Kyowa Interface Science Co., Ltd., while employing three standard liquids (water, nitromethane and methylene iodide), and after which the average of these values was obtained.

Subsequently, three components of the surface energy of each of the dyes and solvents were calculated based on the Young-Dupre equation and the expanded Fowkes equation. Table 1 shows the results.

Incidentally, three-component values of each of the solvents used to prepare stock ink liquids were referred to those of the surface energy, described in Yuji Harazaki, "Coating no Kiso Kagaku (Basic Science of Coating)".

$$WSL=\gamma L(1+\cos\theta) \qquad \text{Young-Dupre Equation}$$

WSL: adhesion energy between liquid and solid

γL: surface free-energy of liquid

θ: contact angle of liquid/solid $$WSL=2\{(\gamma SD\gamma LD)^{1/2}+(\gamma SP\gamma LP)^{1/2}+(\gamma SH\gamma LH)^{1/2}\} \qquad \text{Expanded Fowkes Equation}$$

γL=γLD+γLP+γLH: surface free energy of liquid

γS=γSD+γSP+γSH: surface energy of solid

γD, γP, and γH: dispersion, polarity, and hydrogen bond component of surface free energy

TABLE 1

| Colorant or Solvent | Surface Energy (mN/m) Dispersion Component (γD) | Polarity Component (γP) | Hydrogen Bond Component (γH) |
|---|---|---|---|
| Water | 29.1 | 1.3 | 42.4 |
| Nitromethane | 18.3 | 17.7 | 0 |
| Methylene Iodide | 46.8 | 4 | 0 |
| Ethylene Glycol | 30.1 | 0 | 17.6 |
| Glycerin | 37.4 | 0.2 | 25.8 |

TABLE 1-continued

| Colorant or Solvent | Surface Energy (mN/m) Dispersion Component (γD) | Polarity Component (γP) | Hydrogen Bond Component (γH) |
|---|---|---|---|
| C.I. Disperse Yellow 149 | 41 | 4 | 7 |
| C.I. Disperse Red 302 | 38 | 4 | 4 |
| C.I. Disperse Blue 60 | 45 | 3 | 6 |
| C.I. Disperse Violet 57 | 46 | 3 | 2 |

(Calculation of D(AB))

D(AB) of each of the colorants and solvents (water, ethylene glycol, and glycerin) was calculated based on aforesaid Equation (1), employing dispersion components (γDA and γDB), polarity components (γPA and γPB), and hydrogen bond components (γHA and γHB), each of which was obtained employing the above methods. Table 2 shows the results.

(Determination of Average Particle Diameter)

Scattering intensity of each of the stock ink liquids (prior to the degassing treatment) and the inks (after the degassing treatment), prepared as above, was determined employing Zeta Sizer 1000 produced by Malvern, Inc. Five determined values were averaged resulting in an average particle diameter.

(Determination of Dissolved Oxygen Concentration)

Dissolved oxygen concentration of each of the stock ink liquids (prior to the degassing treatment) and the inks (after the degassing treatment), prepared as above, was determined at 25° C. and one atmospheric pressure, employing a dissolved oxygen meter (Type DO-30A, produced by DKK-TOA Corp.).

(Determination of Viscosity)

Viscosity of each of the inks (after the degassing treatment), maintained at 25±0.1° C., was determined employing a vibration type viscosimeter (DIGITALVISCOMATE VM-100, produced by Yamaichi Electronics Co., Ltd.). The determined value was divided by density and the resulting value was designated as the viscosity. Incidentally, the density was determined employing a portable density meter (DA110, produced by Kyoto Electronics Manufacturing Co., Ltd.)

TABLE 2

| Ink No. | Stock Ink No. | Degassing Treatment Method | D (AB) Colorant vs. Water | Colorant vs. EG | Colorant vs. Gly | Average Particle Diameter (nm) Stock Ink Liquid (a) | Ink (b) | 1* | Dissolved Oxygen Concentration (ppm) Stock Ink Liquid | Ink | Viscosity (mPa · s) | Remarks |
|---|---|---|---|---|---|---|---|---|---|---|---|---|
| 1 | A | 1 | 1407 | 247 | 381 | 175 | 170 | 0.97 | 4 | 1.2 | 8.6 | Inv. |
| 2 | B | 2 | 1606 | 283 | 515 | 165 | 160 | 0.97 | 4 | 1.2 | 8.8 | Inv. |
| 3 | B | 1 | 1606 | 283 | 515 | 165 | 163 | 0.99 | 4 | 1.2 | 8.8 | Inv. |
| 4 | C | 2 | 1571 | 357 | 449 | 180 | 178 | 0.99 | 6 | 0.8 | 8.6 | Inv. |
| 5 | C | 1 | 1571 | 357 | 449 | 180 | 182 | 1.01 | 6 | 0.8 | 8.5 | Inv. |
| 6 | C | 1 | 1571 | 357 | 449 | 180 | 195 | 1.08 | 6 | 0.8 | 8.6 | Comp. |
| 7 | C | 1 | 1571 | 357 | 449 | 180 | 182 | 1.01 | 6 | 2.2 | 8.6 | Comp. |
| 8 | C | 1 | 1571 | 357 | 449 | 180 | 182 | 1.01 | 6 | 4.9 | 8.6 | Comp. |
| 9 | D | 1 | 1877 | 479 | 622 | 135 | 133 | 0.99 | 4 | 0.8 | 8.4 | Inv. |

TABLE 2-continued

| Ink No. | Stock Ink No. | Degassing Treatment Method | D (AB) Colorant vs. Water | Colorant vs. EG | Colorant vs. Gly | Average Particle Diameter (nm) Stock Ink Liquid (a) | Ink (b) | 1* | Dissolved Oxygen Concentration (ppm) Stock Ink Liquid | Ink | Viscosity (mPa · s) | Remarks |
|---|---|---|---|---|---|---|---|---|---|---|---|---|
| 10 | A | 3 | 1407 | 247 | 381 | 175 | 173 | 0.99 | 4 | 1.5 | 8.5 | Comp. |
| 11 | A | 4 | 1407 | 247 | 381 | 175 | 177 | 1.01 | 4 | 1.2 | 8.6 | Comp. |
| 12 | B | 3 | 1606 | 283 | 515 | 165 | 163 | 0.99 | 4 | 1.5 | 8.9 | Comp. |
| 13 | B | 4 | 1606 | 283 | 515 | 165 | 167 | 1.01 | 4 | 1.2 | 8.8 | Comp. |
| 14 | B | 5 | 1606 | 283 | 515 | 165 | 160 | 0.97 | 4 | 5.0 | 8.7 | Comp. |
| 15 | B | 6 | 1606 | 283 | 515 | 165 | 160 | 0.97 | 4 | 1.5 | 8.7 | Comp. |
| 16 | C | 6 | 1571 | 357 | 449 | 180 | 178 | 0.99 | 6 | 1.5 | 8.5 | Comp. |
| 17 | D | 6 | 1877 | 479 | 622 | 135 | 136 | 1.00 | 4 | 1.5 | 8.3 | Comp. |

Inv.: Present Invention
Comp.: Comparative Example
(a): average particle diameter of ink prior to degassing treatment
(b): average particle diameter of stock ink liquid before degassing treatment
1*: (b)/(a)

<<Evaluation of Inks>>

Each of the inks prepared as above was evaluated as described below.

(Ejection Property Evaluation 1)

Each of the inks, prepared as above, was placed in a cartridge and loaded into an ink-jet printer equipped with a piezo type head of a nozzle diameter of 50 μm, a driving frequency of 10 kHz and the number of nozzles of 64, and the driving voltage was controlled to result in each of the volume of ink droplets of 60 pl. Subsequently, 500 ml of each of the inks was continuously ejected at an ambience of 25° C. and 50 percent relative humidity until all the ink was ejected. Until all the ink was ejected, deflection and non-ejection were visually observed, and Ejection Property Evaluation 1 was performed based on the criteria below.

A: all nozzles exhibited stable ejection
B: 1-3 nozzles exhibited deflection and non-ejection
C: 4 7 nozzles exhibited deflection and non-ejection
D: 8-12 nozzles exhibited deflection and non-ejection
E: at least 13 nozzles exhibited deflection and non-ejection (Ejection Property Evaluation 2)

Each of the inks, prepared as above, placed in a cartridge was loaded into an ink-jet printer equipped with a piezo type head of a nozzle diameter of 30 μm, a driving frequency of 20 kHz and the number of nozzles of 64, and the driving voltage was controlled to result in each of the volume of ink droplets of 20 pl. Subsequently, 500 ml of each of the inks was continuously ejected at an ambience of 25° C. and 50 percent relative-humidity until all the ink was ejected. Until all the ink was ejected, deflection and non-ejection were visually observed and Ejection Property Evaluation 2 was performed based on the criteria below.

A: all nozzles exhibited stable ejection
B: 1-3 nozzles exhibited deflection and non-ejection
C: 4-7 nozzles exhibited deflection and non-ejection
D: 8-12 nozzles exhibited deflection and non-ejection
E: at least 13 nozzles exhibited deflection and non-ejection (Ejection Property Evaluation 3 (Evaluation of Storage Stability))

After storing each of the inks in a cartridge at 40° C. for two weeks, ejection was performed in the same manner as for above Injection Property Evaluation 2, whereby Ejection Evaluation 3 was performed.

(Printing Adaptability: Evaluation of Graininess)

(Pre- and Post-treatment of Textiles)

Textiles comprising 100 percent polyester fiber (at a size of 50 d) were previously immersed into pre-treatment agents (a polymer cationic compound and guar gum); squeezed, dried, and subsequently employed.

(Image Printing)

A gradation chart ranging from 0 to 100 percent in terms of dot percentage was printed onto the above textiles, employing an ink-jet textile printer, NASSENGER II (KSD-1600II), produced by Konica Minolta Technology Center, loaded with each of the inks. After printing, the textiles were subjected to a thermal treatment at 180° C. for 10 minutes, washed with water, and subsequently dried. Further, when printed, a piezo type head of a nozzle diameter of 30 μm was employed.

(Evaluation of Graininess)

The degree of graininess of textiles printed as above was visually observed, and graininess was evaluated based on the criteria below.

A: no grainy appearance was noted over the entire gradation range
B: even though some grainy appearance was noted in the low density region, graininess was commercially viable
C: grainy appearance was pronounced in the low density region, but commercially viable
D: grainy appearance was pronounced over the entire gradation range, resulting in problems of commercial viability Table 3 shows the results.

TABLE 3

| Ink No. | Ejection Evaluation 1 | 2 | 3 | Print Suitability Graininess | Remarks |
|---|---|---|---|---|---|
| 1 | A | B | B | B | Inv. |
| 2 | A | B | B | B | Inv. |
| 3 | A | A | A | A | Inv. |
| 4 | A | B | B | B | Inv. |
| 5 | A | A | A | A | Inv. |
| 6 | C | D | D | D | Comp. |
| 7 | C | D | D | C | Comp. |

TABLE 3-continued

| Ink | Ejection Evaluation | | | Print Suitability | |
|---|---|---|---|---|---|
| No. | 1 | 2 | 3 | Graininess | Remarks |
| 8 | D | E | E | D | Comp. |
| 9 | A | A | A | A | Inv. |
| 10 | D | D | D | D | Comp. |
| 11 | C | D | D | D | Comp. |
| 12 | D | E | E | D | Comp. |
| 13 | C | D | C | C | Comp. |
| 14 | E | E | E | D | Comp. |
| 15 | D | E | E | D | Comp. |
| 16 | D | E | E | D | Comp. |
| 17 | E | E | E | D | Comp. |

Inv.: Present Invention
Comp.: Comparative Example

As can clearly be seen from the results listed in Table 3, inks of the present invention, which are prepared employing the degassing method specified in the present invention, exhibit excellent ejection stability and also result in excellent graininess of the formed images.

What is claimed is:

1. A method of producing an ink-jet ink comprising the steps in the order named:

(a) dispersing colorant particles, a dispersing agent, and a solvent mixture containing water and a water-soluble organic solvent so as to obtain a dispersion of the colorant particles;

(b) filtering the dispersion of the colorant particles using a hollow fiber filter; and (c) applying ultrasonic degassing treatment to the filtered dispersion of the colorant particles to obtain the ink-jet ink, wherein a content of oxygen in the ink-jet ink is not more than 2 ppm based on the total weight of the ink-jet ink.

2. The method of producing an ink-jet ink of claim 1, wherein the colorant particles and the solvent mixture have a D(AB) value of not less than 1500, D(AB) being defined by the following Formula (1):

$$D(AB)=(\gamma D_A-\gamma D_B)^2+(\gamma P_A-\gamma P_B)^2+(\gamma H_A-\gamma H_B)^2 \quad \text{Formula (1)}$$

$\gamma D_A$: a dispersive component of a surface energy for the colorant particles obtained by Young-Fowkes equation;

$\gamma D_B$: a dispersive component of a surface energy for the solvent mixture obtained by Young-Fowkes equation;

$\gamma P_A$: a polar component of a surface energy for the colorant particles obtained by Young-Fowkes equation;

$\gamma P_B$: a polar component of a surface energy for the solvent mixture obtained by Young-Fowkes equation;

$\gamma H_A$: a hydrogen bonding component of a surface energy for the colorant particles obtained by Young-Fowkes equation; and $\gamma H_B$: a hydrogen bonding component of a surface energy for the solvent mixture obtained by Young-Fowkes equation.

3. The method of producing an ink-jet ink of claim 1, wherein the colorant particles are a dispersion dye.

4. The method of producing an ink-jet ink of claim 1, wherein a viscosity of the ink-jet ink is from 5 to 15 mPa·s.

5. The method of producing an ink-jet ink of claim 1, wherein a content of the colorant particles in the ink-jet ink is from 3 to 20 weight % based on the total weight of the ink-jet ink.

6. A method of recording an ink-jet image comprising the step of:

ejecting droplets of the ink-jet ink produced by the method of claim 1 from a multiplicity of nozzles of an ink-jet head onto a recording material, wherein a diameter of the nozzles is from 10 to 50 μm.

7. A method of recording an ink-jet image comprising the step of:

ejecting droplets of the ink-jet ink produced by the method of claim 1 from a multiplicity of nozzles of an ink-jet head onto a textile material, wherein the textile material is a polyester fiber having a ink receptive layer thereon.

* * * * *